United States Patent [19]

Jeng

[11] Patent Number: 4,566,139

[45] Date of Patent: Jan. 28, 1986

[54] PISTON PLUNGER

[76] Inventor: Chi-Cheng Jeng, No. 32 Chien Kuang Rd., Kaohsiung, Taiwan

[21] Appl. No.: 558,472

[22] Filed: Dec. 6, 1983

[51] Int. Cl.[4] ..... E03D 11/00

[52] U.S. Cl. ..... 4/255

[58] Field of Search ..... 4/255–257

[56] References Cited

U.S. PATENT DOCUMENTS

| | | | |
|---|---|---|---|
| 1,574,274 | 2/1926 | Allender | 4/256 X |
| 2,498,359 | 2/1950 | Coleman | 4/255 |
| 2,670,475 | 3/1954 | Hord | 4/256 |
| 4,186,451 | 2/1980 | Ruo | 4/256 X |

*Primary Examiner*—Charles E. Phillips

*Attorney, Agent, or Firm*—Holman & Stern

[57] ABSTRACT

A piston plunger consists of a suction cup, a cylindrical tube and a handle. Inside the cylindrical tube is a piston. A small air hole is provided in a connector between the suction cup and the cylindrical tube through which air inside of the cup can pass. The handle has an air vent. When a clogged water pipe or the like needs to be cleaned, the suction cup is placed directly on the opening of the pipe and downward pressure is applied to the suction cup. The air compressed in the cup passes through the air hole in the connector and forces the piston up the tube until the cup is pressed down tightly against the opening. There is sufficient clearance between the piston and the tube for the piston then to drop down the tube under gravity with the trapped air being free to escape through the vent in the handle. Repeatedly downwardly pressing the plunger in this manner is effective to unclog the pipe.

1 Claim, 4 Drawing Figures

Fig. IA

PISTON PLUNGER

BACKGROUND OF THE INVENTION

Clogging of water pipes, toilets and the like is a common problem and there are many kinds of simple suction devices available for unclogging same. The most common device consists of a solid handle and a hemispherical suction cup, the device being operated by placing the suction cup directly on the opening of a pipe or the like and pressing down repeatedly on the handle. Because there is no air passage between the handle and the suction cup, air trapped and compressed within the suction cup has to escape from the edge of the suction cup when the cup is pressed down. In order to improve the suction effect of the known devices, Applicant has developed a novel piston plunger.

BRIEF DESCRIPTION OF DRAWINGS

FIG. 1A is a cross sectional view on line AA of FIG. 1.

DESCRIPTION OF PREFERRED EMBODIMENT

Figure 1:
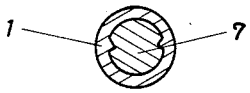
FIG. 1 is a cross sectional elevational view of a piston plunger in accordance with the invention.
Figure 1:
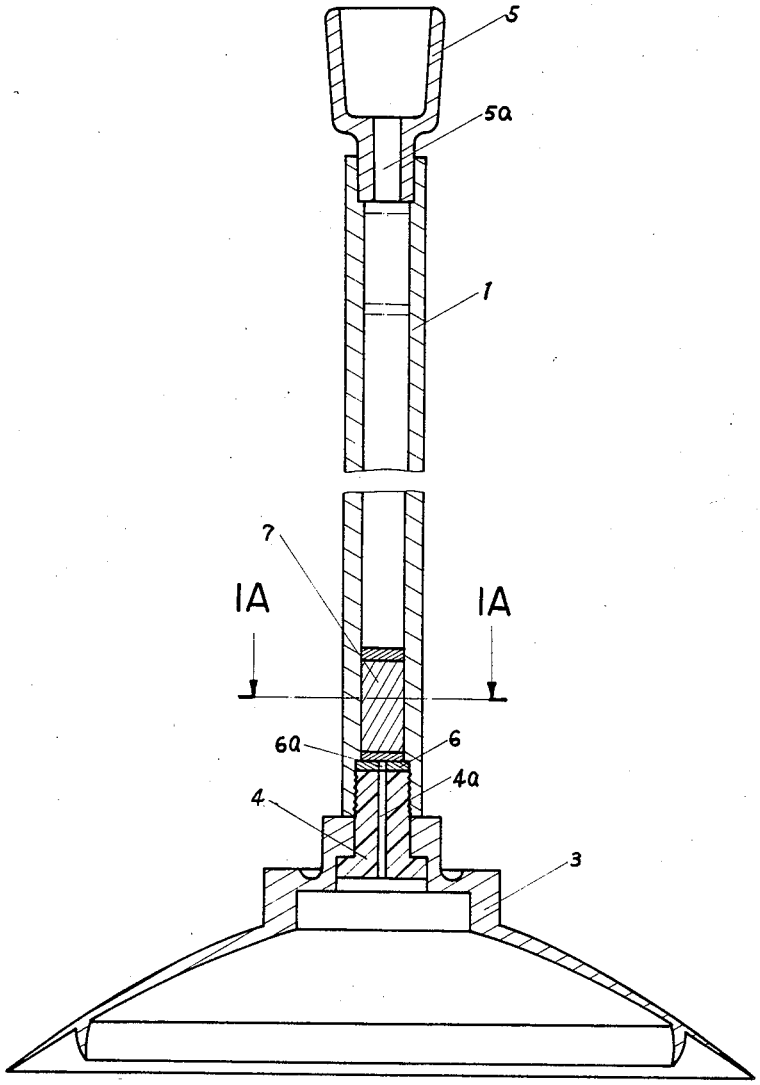

The illustrated piston plunger includes a cylindrical tube 1 with a piston 7 that can move freely up and down inside the cylindrical tube. The bottom part of the cylindrical tube is threaded to the upper part of a connector 4 which is itself connected with the base of a suction cup 3. Consequently, cylindrical tube 1 is completely linked with the suction cup 3, and an air hole 4*a* is formed through the center of the connector 4 to enable air to pass through into the cylindrical tube 1 from the suction cup 3.

The top part of the cylindrical tube 1 is combined with a handle 5 having an air vent 5*a* which communicates with the central empty space of the cylindrical tube 1 forming a vent for air to pass through into the outside atmosphere. Therefore, the suction cup 3, cylindrical tube 1, and handle 5 together constitute an air passage through the plunger.

Figure 2:
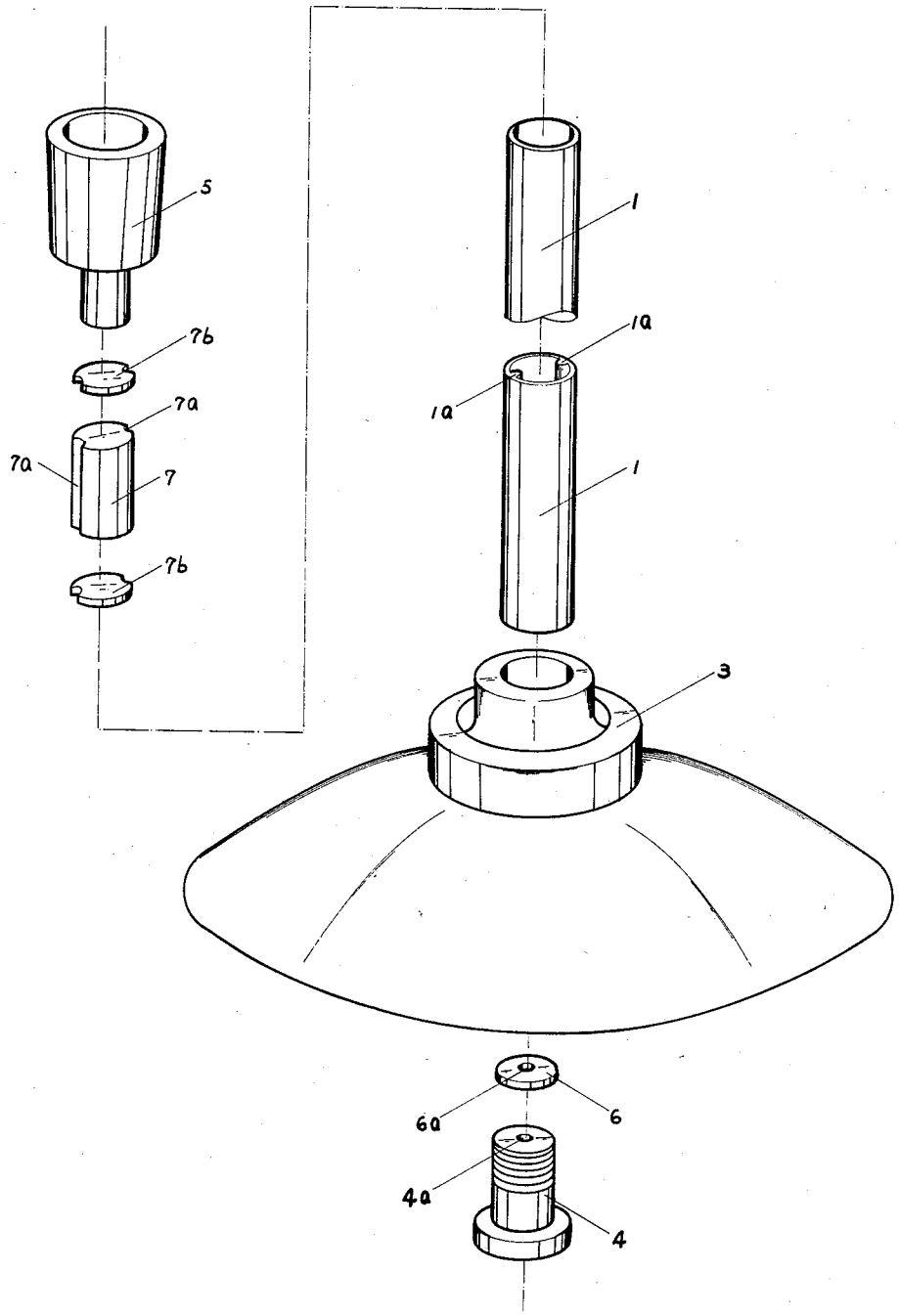
FIG. 2 is an exploded perspective view of the piston plunger.
Figure 3:
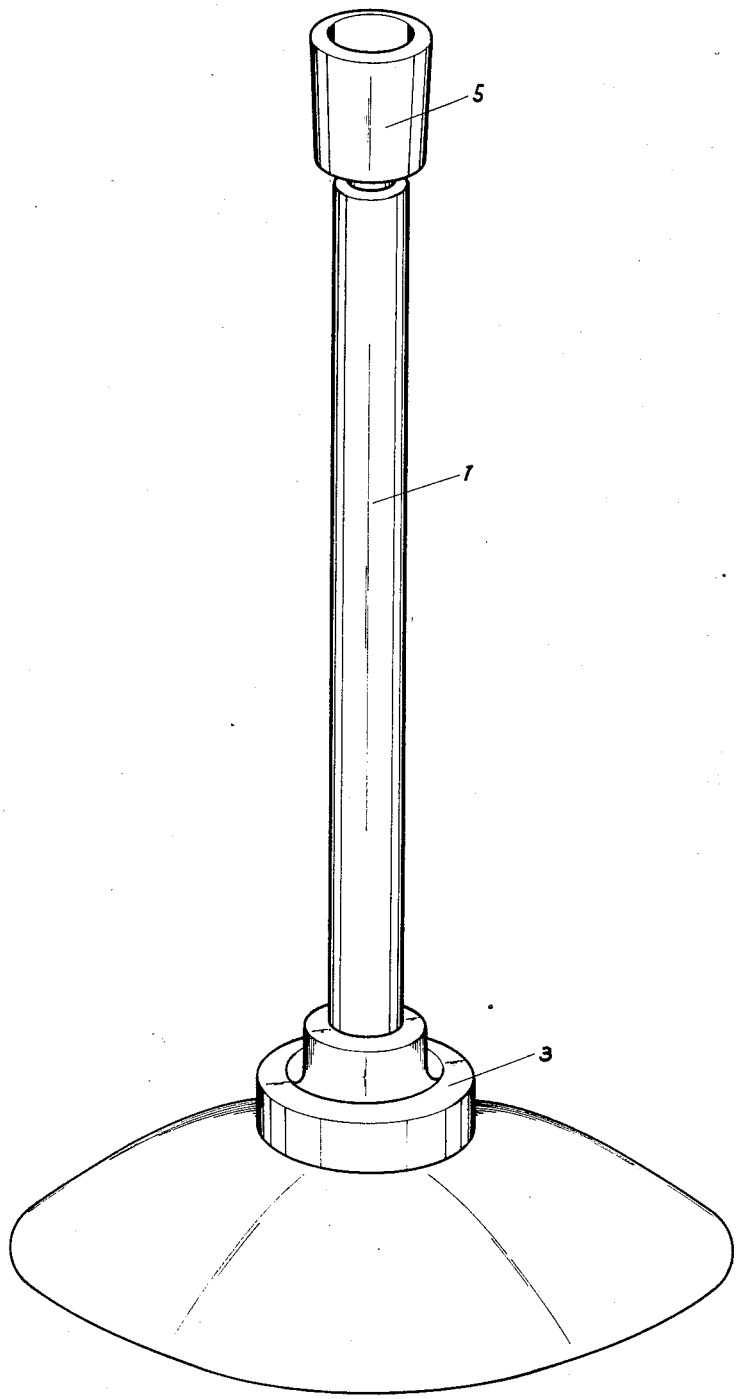
FIG. 3 is a general perspective view of the piston plunger.

As shown in FIGS. 1 and 2, the interior of the cylindrical tube 1 is hollow and on its inside wall are two symmetrical lengthwise piston-guiding rails 1*a*. A rubber gasket 6 with a central air hole 6*a* is attached on top of connector 4. Piston 7 has two guiding flutes 7*a* to fit the piston-guiding rails thereby guiding movement of the piston up and down the cylinder. There are two rubber gaskets 7*b* respectively attached to each end of the piston 7. When the piston 7 drops down to the position shown in solid line in FIG. 1, air holes 4*a*, 6*a* are both sealed by rubber gasket 7*a* so that air cannot pass from the suction cup into the cylindrical tube. When the piston is pushed to the top of the tube, the air passage or vent 5*a* is sealed by the rubber gasket 7*b* so that bad air or waste water can be prevented from running up or spilling out of the handle.

The piston plunger, though its structure is simple, has a powerful functioning capability. In operation, when a pipe, toilet, or the like is clogged, a user grip the handle 5, puts the suction cup 3 directly on the opening of the pipe or the like, then presses down on the handle. The air in the suction cup 3 is compressed and forced through holes 4*a*, 6*a*, pushing up the piston 7 from the bottom of the tube. The suction cup 3 becomes tightly suctioned onto the opening of the pipe or the like, and the provision of a slight gap between guides 1*a* and flutes 7*a* allows the piston to drop gravitationally back down against the top of connector 4 whereby the air previously trapped in tube 1 is free to escape through vent 5*a*. The above-mentioned operation may then be repeated to relieve clogging of the pipe or the like.

I claim:

1. A piston plunger comprising a suction cup, a connector at the base of the cup, a cylindrical tube extending from the connector, a handle on the end of the tube, and a piston inside of the cylindrical tube, the connector having an air hole for connecting the interior of the cylindrical tube with the interior of the suction cup, the handle including an air vent communicating with the interior of the cylindrical tube, a pair of symmetrical piston-guiding rails on the internal wall of the cylindrical tube, a pair of guiding flutes on the piston interfitting with the guiding rails to enable the piston to move up and down in the cylindrical tube, each end of the piston having a rubber gasket, whereby pressing down on the plunger with the suction cup engaging over the opening of a clogged pipe or the like causes air in the suction cup to be forced through said air hole in the connector and into the cylindrical tube pushing the piston up the tube until the suction cup is suctioned against the opening, whereupon air in the tube can pass between the piston-guiding rail and the guiding flutes so that the piston may drop gravitationally down onto the connector and whereby repeating the action of pressing the plunger down against the opening is effective for unclogging the pipe or the like.

* * * * *